United States Patent [19]

Hergeth

[11] Patent Number: 4,475,270

[45] Date of Patent: Oct. 9, 1984

[54] CONTROL DEVICE FOR OPENING FIBER BALES

[75] Inventor: Hubert A. Hergeth, Dülmen, Fed. Rep. of Germany

[73] Assignee: Hergeth Hollingsworth GmbH, Fed. Rep. of Germany

[21] Appl. No.: 391,377

[22] Filed: Jun. 23, 1982

[30] Foreign Application Priority Data

Jun. 23, 1981 [DE] Fed. Rep. of Germany ..... 3124569

[51] Int. Cl.[3] ..... D01G 13/00

[52] U.S. Cl. ..... 19/81

[58] Field of Search ..... 19/80 R, 81

[56] References Cited

U.S. PATENT DOCUMENTS 3,443,285 5/1969 Goldammer et al. ..... 19/81

4,087,882 5/1978 Keller ..... 19/81 X 4,107,820 8/1978 Mahrt et al. ..... 19/81

*Primary Examiner*—Louis Rimrodt

*Attorney, Agent, or Firm*—Diller, Ramik & Wight

[57] ABSTRACT

This disclosure relates to a control device for opening fiber bales arranged in a row including a carriage movable along a horizontal rail and carrying a slide which is vertically reciprocal with the slide carrying grabbing fingers which can both grab and release a fiber bale, such as a pressed bale of cotton, and a pneumatic control circuit for pneumatically oscillating the carriage, operating the grabbing fingers and moving the slide up and down, the pneumatic control system also including a program wheel carrying a plurality of contact cams which operate a valve to initiate the cycling of the device and a pneumatically operated ratchet for indexing the program for appropriately cycling the control device and moving the fiber bales as desired.

7 Claims, 11 Drawing Figures

9
10
24
12

23
6
30
26
29
28
20
27
23a
2
25

6
30
26
29
28
27
20
23a

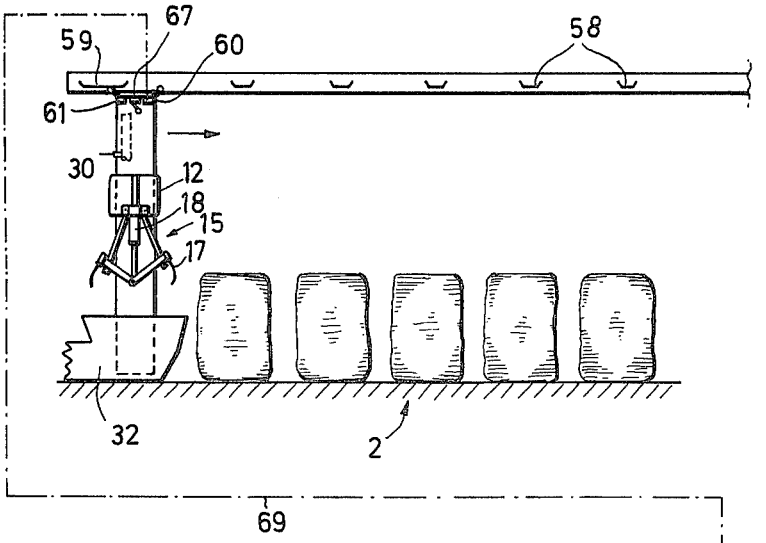
FIG.9
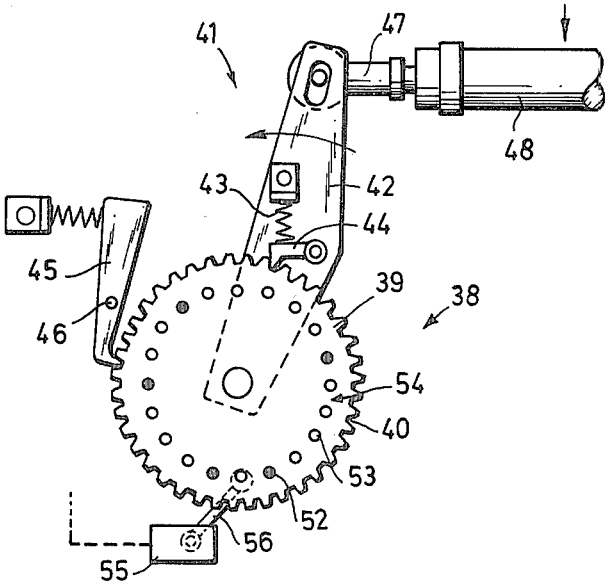

CONTROL DEVICE FOR OPENING FIBER BALES

The invention relates to a control device for opening fiber bales arranged in a row, in particular pressed bales of cotton, for producing a mix of the fiber material removed from the bale, in which a grabbing means being displaceable by means of a carriage above and along the row of bales to a drop point is movable up and down at the carriage, the grabbing means comprising a grab head having fingers that can be opened and closed.

Devices for opening hard-pressed cotton bales from which the fiber material is removed from the top have been known in different configurations. In one embodiment, a carriage movable along a row of bales is provided with a column mounted on the carriage and in which one or several grabbing means are conducted by being displaceable in height to project beyond the arranged row of bales which are situated on a support in high position. Below the row of bales, there is a conveyer belt running between the support frames and taking away the fibrous material dropped between the supports to be further processed.

In another embodiment, the grabbing means are arranged at tilting arms coacting in a parallelogram-like manner and pivoted at a carriage movable beside the row of bales. A conveyer belt provided above the row of bales can be tilted to avoid interfering with the grabs. Upon a pick-up of the fibrous material, the conveyer belt is tilted to the horizontal position to receive the fiber material from the grabs. It is the purpose of the tiltable conveyer belt to exclude between the individually arranged fiber bales an interspace for dropping the fiber material. In another embodiment, the conveyer belts to receive the fibers removed from the fiber bales are provided either at the side of the movable carriage or at the other side of the row of bales, a tiltable conveyer belt extending transversely to the row of bales supplying the fibrous material. In place of the conveyer belts, there are also provided flaps which can be swivelled out of the reach of the grabbing means the fiber material being able to drop from the swivelled position to the bottom conveyer belt to be taken away from there.

There have been known devices for opening a plurality of pressed bales which are arranged successively in a row and in rows side by side. To this effect, a crane system is used in which a crane truck can be moved on two rails spaced from each other. The crane truck is provided with a trolley movable transversely to the rails and at which the grabbing means and their motion system are mounted. The control of the crane truck, of the trolley and of the grabbing means is achieved by electronic switch elements.

It is the object of the invention to provide a control device for an apparatus to open fiber bales of the type mentioned at the outset hereof, in which, with a low expenditure, the contol of all moving parts of the opening device is realised in a simple and clear manner by saving cost. The control device of the invention is characterized in that for the oscillating movement of the carriage, the lifting and lowering of the grab head and the opening and closing of the grab fingers a pneumatic control device is provided and that the movement of predetermined parts of the device is initiated by means of a switching assembly designed as a program wheel.

The simple and clear construction as well as the accessibility with respect to the control arrangement and control operations of the pneumatic control system with the program wheel offer outstanding advantages. The control system is very robust. Only a compressed air source is necessary which can be easily mounted. The pneumatic control system meets the requirements of a competitive price. Furthermore, the established program control can be well summed up and it is easy to reprogram it. Besides, the switching wheel can be easily changed against another of a different program and of a more restricted or larger range. It is also easy to use a homemade construction of the switching wheel and the switching system.

According to another feature of the invention, the peripheral teeth of the switching wheel are coacting with a ratchet means by providing displaceable contact cams. To this effect, the ratchet means can be connected to a pneumatically operated adjusting cylinder and a pneumatic switch valve engages the contact cams, which, preferably are pins or the like that can be inserted upon demand in prepared perforations of at least one row of holes fitted on a circle.

By this means, programming and reprogramming for the required switching operations can be easily and very clearly carried out. Unlike the electric or electronic control, the system of the invention does not call for a specialist to set up and monitor the control and to change the program. A normal operator skilled in this mechanical field is well able to perform these duties. The clear insight concerning the programmed switching system is a guaranty for its particular reliability.

It turned out to be suitable to use rocking lever valves for the actuation of the switching wheel and the setting of the corresponding carriage position as well as for the tackle, which valves, when actuated, send off compressed air, while the system is vented when they are inoperative.

For the movement of the carriage, lifting and lowering the grab head, opening and closing the grab fingers, pulse valves should be used which can be reversed by air pulses and which maintain the corresponding positon unless a counterpulse is supplied.

The object of the invention will be explained hereinafter more closely by means of an embodiment shown in the drawing.

FIG. 1 shows a perspective and schematic view of an embodiment of the equipment for reducing fibrous bales placed in a row according to the invention, FIG. 2 is a schematic end view of the device of FIG. 1, FIG. 3 is a schematic view on the carriage of the device of FIG. 1 with grabbing means, FIGS. 4, 5, 6 illustrate the plan view and scheme of different possibilities to arrange the plant with respect to the bales put up in a row, and of the drop points.

FIG. 9 shows an elevation and schematic illustration of an embodiment of the pneumatic control system according to the invention in association with the switching wheel or program wheel.

Figure 1:
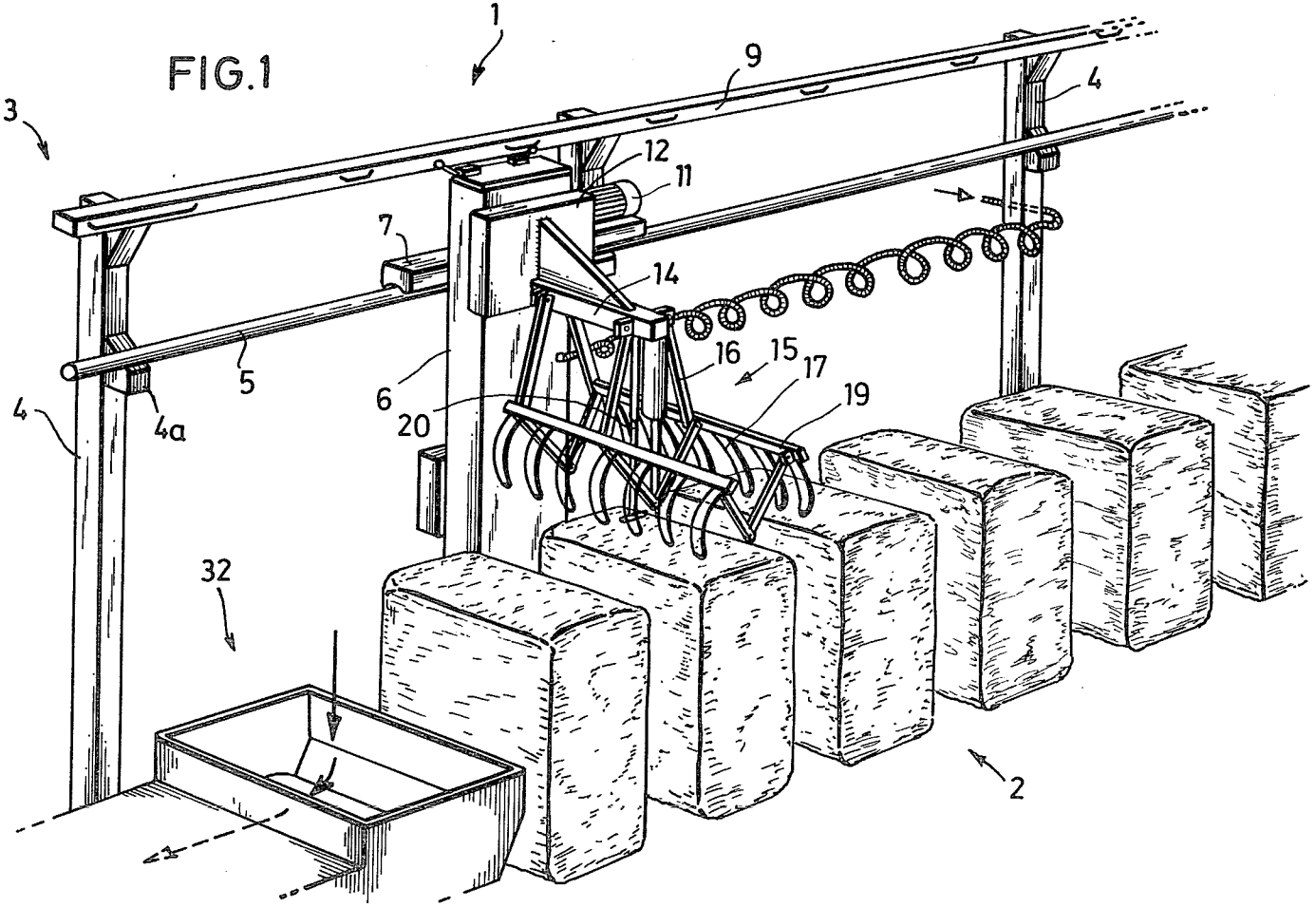
Figure 2:
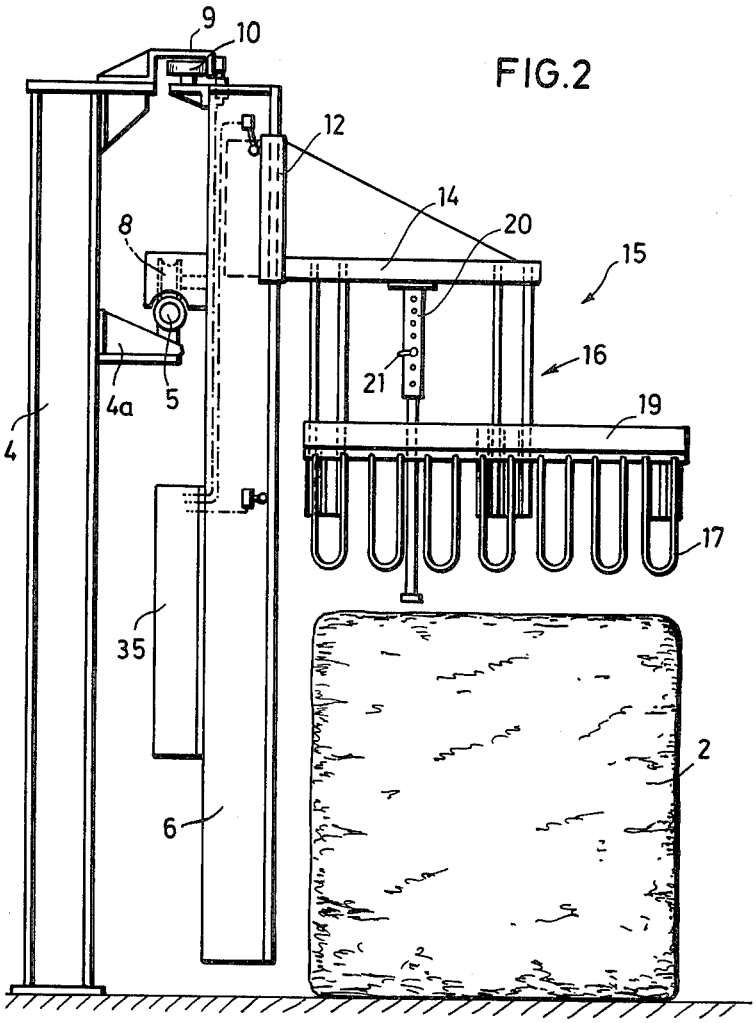
Figure 3:
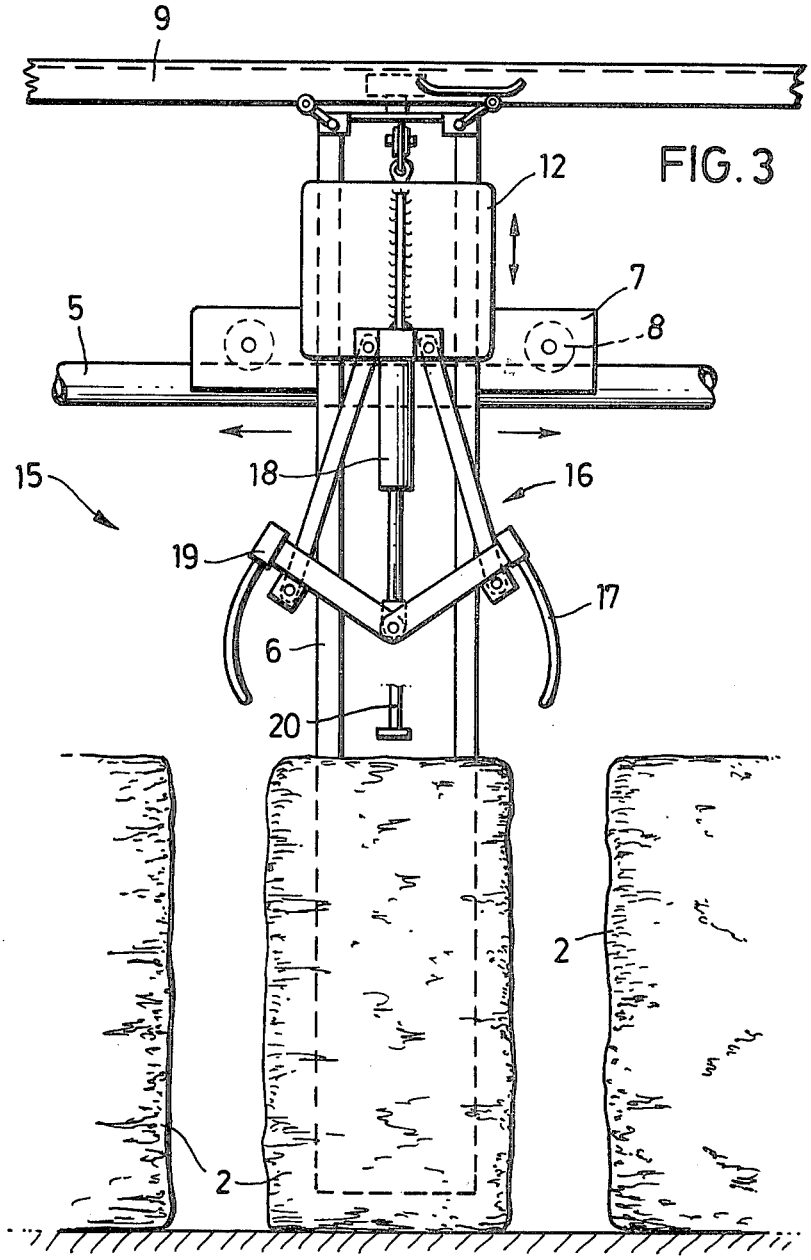

The device 1 for opening or reducing fiber bales 2 arranged in a row, in particular pressed cotton bales comprises a frame 3 formed by supports 4 and by a rail 5 firmly connected to said supports. On the running rail 5, a carriage 6 is supported by means of an extension 7 comprising rollers 8, the carriage being freely suspended in downward direction. The running rail 5 is preferably formed by a tube resting on brackets 4*a* of the supports 4, the rollers 8 having a tread surface adapted to the tube periphery, thus achieving a perfect guidance. Another rail 9 provided at or near the upper end of the carriage 6 is borne by the supports 4. Said additional rail 9 serves for the lateral supporting of the hanging carriage 6 by means of rollers 10 or the like which abut from the inside against a leg of the angular- or U-shaped rail 9. Thus, the carriage 6 is maintained in perpendicular position. A motor 11 driving via a gear one of the running rollers 8 serves as a drive for the carriage 6. Along the carriage 6, there is displaceably fitted a slide 12 being provided with a bracket 14 to mount the grabbing means 15 which comprises rods 16 including grabbing fingers 17. The rods 16 are adjusted by means of a piston-cylinder unit 18 engaging the levers 19 provided with the grabbing fingers 17. The slide 12 with the bracket 14 can be provided with a key head of telescopic design, in which the telescopic elements are adjustable relative to each other and can be stopped by means of a locking means 21.

Figures 7, 8:
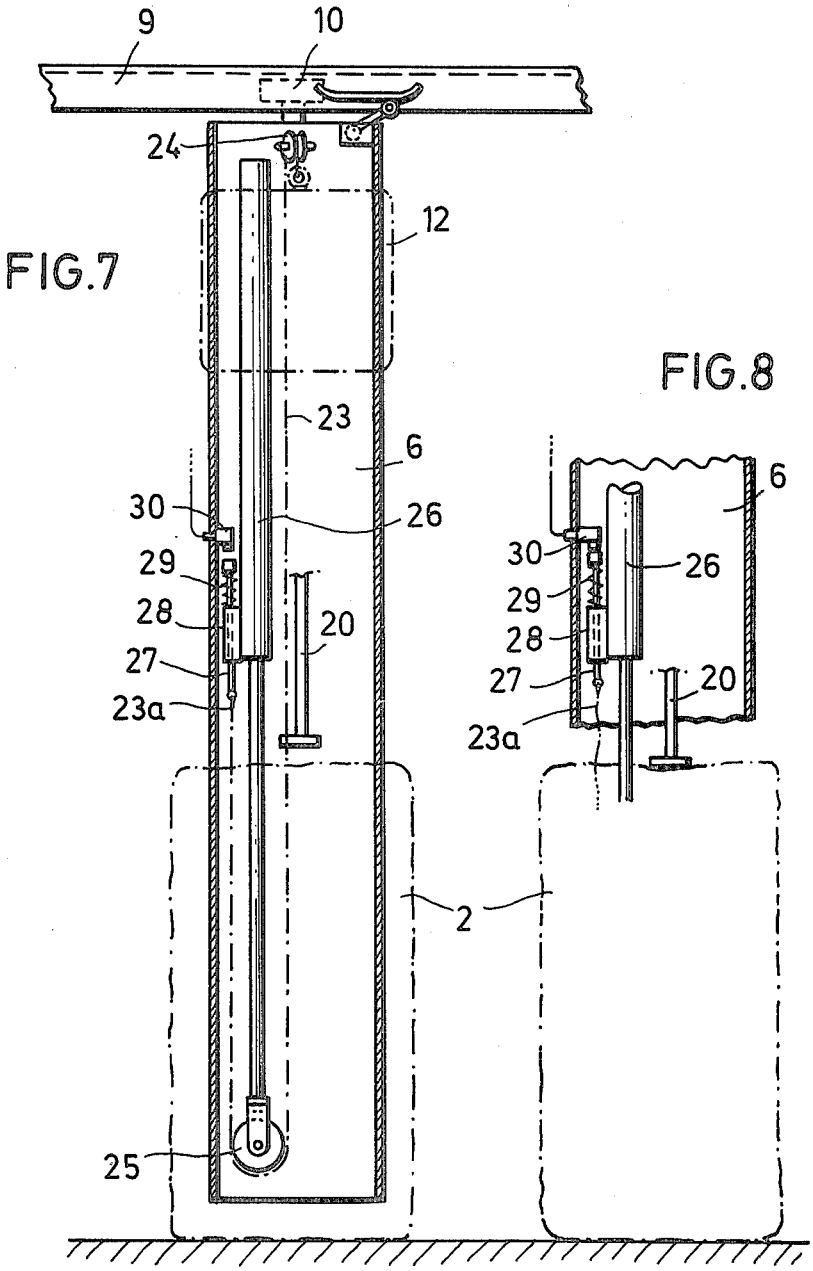
FIGS. 7 and 8 show a schematic embodiment of the design concerning the lifting and lowering movement of the grab head at the suspended carriage by means of a tackle line in different positions.

The slide 12,14 with the grab head 15 is adjustable in height by means of a tackle line 23. To this effect, the end of the tackle line 23 secured to the slide 12 is guided via an upper stationary guide roller 24 and via a lower guide roller 25 which is adjustable in height by means of a piston-cylinder unit 26 operated pneumatically. The stationary end 23*a* of the tackle line 23 is connected to a rod 27 or the like supported displaceably in a stationary mounting 27 and being under the action of a compression spring. The displaceable rod 27 may operate as a contact member to initiate the operation of the grab fingers by means of the piston-cylinder unit 18. In FIG. 7, the slide 12 with the grab head 15 is in the uppermost position, while the piston-cylinder unit 26 is moved out as far as possible. As soon as the adjustable key head 12 or the grab fingers 17 of the grabbing means find a resistance due to the bale surface, the downward movement of the slide 12 with the grab head 15 is stopped. The piston-cylinder unit 26 with the lower guide roller 25 moving further backward, the tackle line 23 will slacken. As a result, the compression spring 29 held in compressed position during the lowering of slide 12 and with the stretched tacke line 23, will be released. Therefore, the rod 27 is displaced towards a contact of a valve 30 by which the actuation of the grab fingers 17 is controlled. By the suspension of the slide 12 with the grab head 15 with the aid of a tackle line 23, the lowering movement of the slides 12 with the grab head 15 can be stopped automatically in any optional height of the bale 2, and the grab fingers are actuated by said stop. Thus, a simple and reliable control of the grab head and of the grab fingers is obtained.

Figure 4:
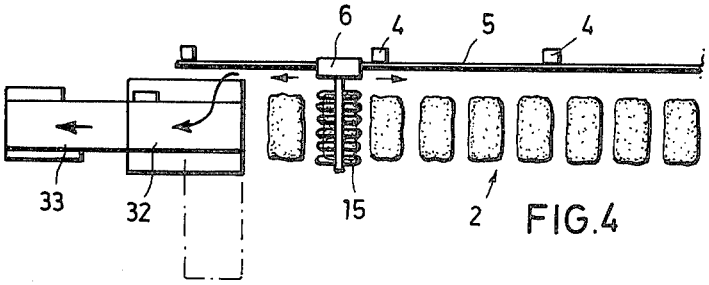
Figure 5:
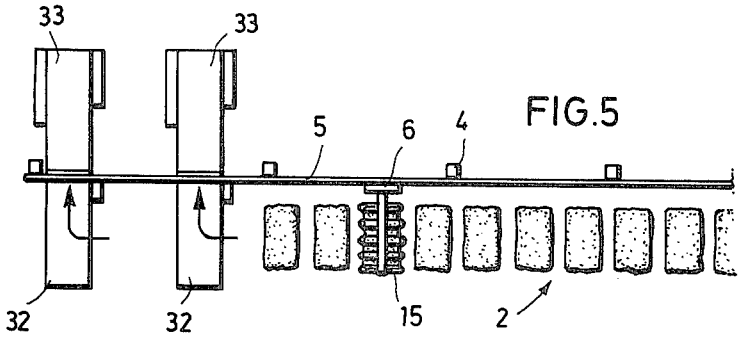
Figure 6:
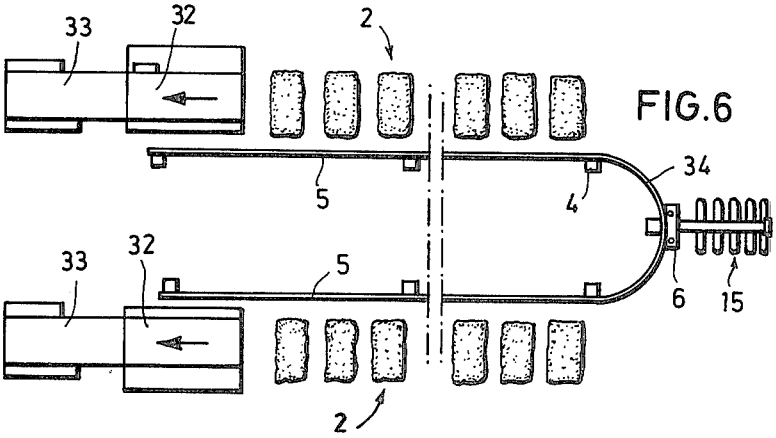

At the end of a row of bales, there is a drop point 23 which can be provided as a hopper feeder or as a conveying means 33 to carry away the fiber material mix. The hopper feeder 32 with the conveying means may extend in direction of the row of bales according to FIG. 4 or in transverse direction as shown in FIG. 5, it being possible to provide more than one hopper feeder for one row of bales. It is also feasible to provide frame 1 with running rail 5 with at least one reversing curve 34 thus permitting to locate more than one row of bales. At the end of each row of bales, one hopper feeder each with a conveying means is arranged such as obvious from FIG. 6. At the same time, more than one carriage 6 can be provided at the running rail 5. The removed fiber material is carried away always at the beginning of the corresponding row of bales. The running rail of the frame may be also of a continuous design.

Figure 10:
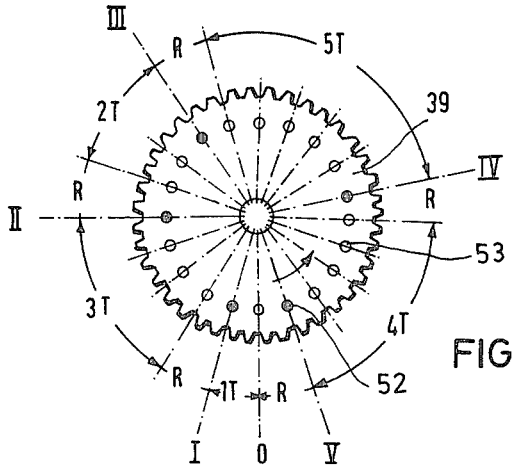
FIG. 10 shows the schematic view of the switching wheel or program wheel in connection with a particular example.
Figure 11:
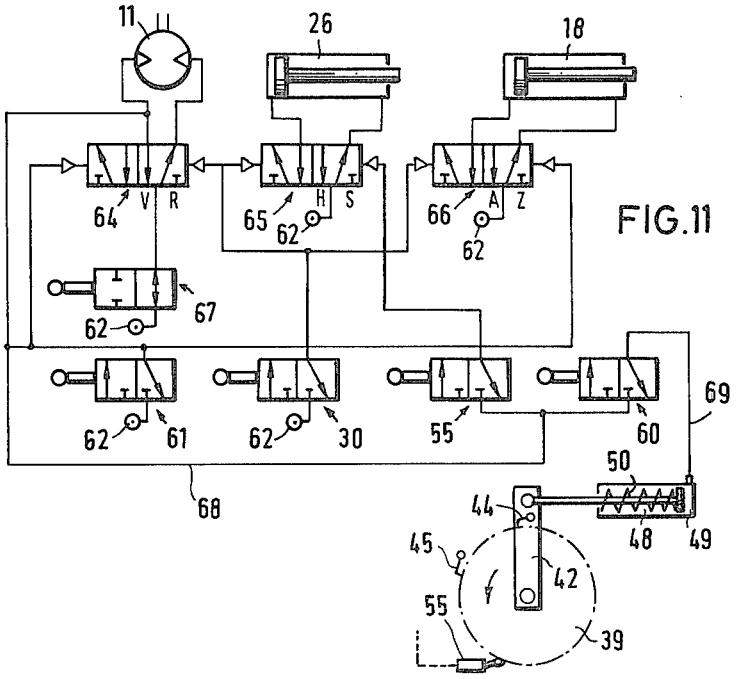
FIG. 11 is a schematic illustration of a pneumatic wiring diagram for valves in connection with the switching wheel.

The control system for the movement of all movable parts of the equipment for the automatic removal of fibrous bales disposed in a row is illustrated in FIGS. 9 to 11. For the oscillating movement of the carriage 6, the lifting and lowering of the grab head 15 and the opening and closing of the grab fingers 17, a pneumatic control device 37 is used by which the movement of predetermined elements of the device is initiated with the aid of a switching system 38 containing a program wheel. The switching system 38 contains a switching wheel 39 having a toothed periphery 40. The teeth 40 engage a ratchet means 41 which may comprise a stop lever 42 with a pawl 44 being under the action of a spring 43 and a spring-loaded lever 45 pivotable about the pin 46 and engaging with a nose the teeth 40 to secure the position of the switching wheel as imparted by the stop lever 42, which is hinge-connected with the piston rod 47 of a pneumatically operating adjusting cylinder 42 designed as a simply acting cylinder having a piston which is under the action of a spring 50. The switching wheel 39 is provided with displaceable contact cams, e.g. in the form of pins 52 which can be inserted into perforations 53 of at least one row of holes 54 fitted on a circle. A switch valve 55 engages the contact pins 52 by means of a movable lever 56.

The upper rail 9 is provided with so-called bale marks, e.g. skids 58 to mark the bale stocks e.g. I to V, and with a skid 59 intended for the drop point 32. A valve 60 at the carriage 6 is coacting with the skids 58 and a valve 61 is coacting with skid 59 at the drop point.

During the forward movement of the carriage 6 in direction of arrow 77 or towards the bales, the switch valve 60 successively contacts the skids 58. However, the switching wheel 39 is only actuated if switch 55 permits indexing. FIG. 10 illustrates a specific rhythm in connection with 5 bales corresponding to the contact pins 52 set in the circle of holes 53 and coacting with the corresponding switch 55. If the switching wheel 39 or a cam 52 reaches switch 55, the latter supplies a pulse to a valve via a compressed air line to cylinder 26. The slide 12 is lowered until the key head 20 or the grab fingers abut against the bales. The tack line 23 slackens and the spring 29 presses the rod 27 against a switch of valve 30 actuating a corresponding sequence switching. At the same time, a pulse is supplied to the adjusting cylinder 48 thus releasing switch 35 in advancing the switching wheel 39 by one circle of holes. Two teeth meaning one clock step R are indexed. The adjusting cylinder may be operated pneumatically, electrically or electromagnetically.

All valves and the switching wheel are housed in a switch box 35 which may be mounted at the rear side of the carriage 6.

As evident from the pneumatic wiring diagram of FIG. 11, the control operations are as follows: Valves 61 for the hopper feeder contact, 30 for the tackle contact, 55 for the ratchet contact and 60 for the bale mark 58 are rocking lever valves which, when actuated, supply compressed air and, when inoperative, cause venting. On the other hand, valves 64 for the movement of the carriage 6 in forward direction to the bales and in rearward direction to the drop point, 65 for lifting and lowering the slide with the grab head and 66 for opening and closing the grab fingers are pulse valves which are reversed by short air pulses and which maintain said position until a counterpulse is given. Valve 67 in the compressed air line is actuated continuously. The corresponding compressed air lines are designated with 62.

From the position of the grabbing system 15 in which the material is dropped above the drop point 32, the grabbing system being on its way to the bales, the outputs V, H A of the pulse valves are under the action of compressed air. At the compressed air line V at valve 64 which is operating the pneumatic motor 11, a line 68 is branched off to supply compressed air to the rocking lever valves 60 and 55. The carriage 6 moves towards the bales.

Each time when valve 60 is actuated by a skid 55 of the rail 9, the rocking lever valve 60 supplies an air pulse via line 69 to the adjusting cylinder 48 with spring resetting 50. The cylinder is actuating the pawl 44 indexing switching wheel 39 by a determined angle. The contact cams 52 are actuating in the desired position the ratchet contact valve 55. To approach for inst. bale IV, four non-occupied positions 53 being no contact cams 52 pass by the ratchet contact valve 55. In the fifth position, there is a contact cam 52 which actuates the ratchet contact valve 55 via the fifth bale IV.

Said ratchet contact valve 55 supplies an air pulse to reverse the pulse valve 65 to lowering thus causing the grab head 15 to lower. As a result, the valve 67 as a 2/2 way-valve is not actuated any longer so that the supply to the compressed air motor 11 is interrupted. The carriage stops and the grab head 12,15 is lowered until it rests on the surface of the corresponding bale. The tackle line 23 is relieved and the rocking lever valve 30 is actuated by means of spring 29 accordingly. Said valve supplies compressed air to the pulse valves which are reversed to the positions "lifting, grabbing, return travel".

The grab fingers are closed and the grab head is lifted. As soon as the grabbing system is again in its upper most position, the 2/2 way-valve 67 is actuated, the motor 11 is provided again with compressed air and moves to the drop point 32. The valve 60 not being provided any longer with compressed air, the adjusting cylinder 48 is inoperative during the return movement. Carriage 6 travels to the drop point 32 where the skid 59 actuates the hopper feeder valve 61 supplying an air pulse to reverse valves 64,66 to the forward and opening action of the grabs. The grab fingers are opened to drop the material. Carriage 6 has changed is direction of travel and is again moved towards the bales.

The number of positions required at the switching wheel periphery is determined by the size of the switching wheel. In practice, 15 to 20 bales approximately can be served by the switching wheel.

What is claimed is:

1. A control device for opening fiber bales arranged in a row comprising oscillating carriage means for moving a row of fiber bales along a predetermined path of travel, grabbing means for selectively grabbing and releasing fibers from individual bales of the row of bales, means for mounting said grabbing means for up and down movement relative to said carriage, pneumatic control means for (a) pneumatically oscillating said carriage means, (b) pneumatically operating said grabbing means and (c) pneumatically moving said grabbing means up and down, switching means including a program wheel for controlling the operation of said pneumatic control means, said program wheel including a plurality of spaced peripheral teeth defining notches therebetween for receiving a nose of a ratchet, means for imparting motion to the ratchet to move said program wheel through a predetermined angle, a plurality of peripherally spaced contact cams carried by said program wheel, and switching valve means operated by each contact cam for initiating the cycling of said pneumatic control means.

2. The control device as defined in claim 1 wherein said contact cams are pins selectively positioned in holes arranged along an arc of said program wheel.

3. The control device as defined in claim 2 including a lever carrying said ratchet, pneumatic piston-cylinder means for moving said lever in response to carriage means movement to move said program wheel to a predetermined position, and means for holding said program wheel at each of its predetermined positions.

4. The control device as determined in claim 3 wherein said holding means is a spring-loaded lever which is automatically urged to its holding position.

5. The control device as defined in claim 4 wherein said pneumatic control means includes a plurality of valve means for controlling the flow of pressurized air through a pneumatic circuit of said pneumatic control means, a first of said valve means being pneumatically connected to said pneumatic piston-cylinder means, another of said valve means defining said switching valve means, a further of said valve means controlling said grabbing means up and down movement, and a final one of said valve means controlling the release of a bale by said grabbing means.

6. The control device as defined in claim 5 wherein at least some of the said plurality of valve means are pulse valves reversible by short air pulses.

7. A control device for opening fiber bales arranged in a row comprising oscillating carriage means for moving above a row of fiber bales along a predetermined path of travel, grabbing means for selectively grabbing and releasing fibers from individual bales of the row of bales, means for mounting said grabbing means for up and down movement relative to said carriage, pneumatic motion means for (a) pneumatically oscillating said carriage means by a pneumatic motor, (b) pneumatically operating said grabbing means and (c) pneumatically moving said grabbing means up and down, and control and switching means including a program wheel for controlling the operation of all said pneumatic motion means.

* * * * *